United States Patent [19]

Iwasaki

[11] 4,104,890

[45] Aug. 8, 1978

[54] AIR CONDITIONING APPARATUS

[75] Inventor: Ryohei Iwasaki, Fujisawa, Japan

[73] Assignee: Matsushita Seiko Co., Ltd., Osaka, Japan

[21] Appl. No.: 823,172

[22] Filed: Aug. 8, 1977

Related U.S. Application Data

[63] Continuation of Ser. No. 692,579, Jun. 3, 1976, abandoned.

[51] Int. Cl.[2] ..... F25B 13/00; F25B 7/00; F25B 1/10

[52] U.S. Cl. ..... 62/324; 62/335; 62/510

[58] Field of Search ..... 62/262, 263, 335, 498, 62/499, 510, 442, 324

[56] References Cited

U.S. PATENT DOCUMENTS

| | | | |
|---|---|---|---|
| 2,155,484 | 4/1939 | Gottlieb | 62/335 |
| 2,453,823 | 11/1948 | Williams | 62/335 |
| 2,456,386 | 12/1948 | Cooper | 62/335 |
| 2,796,743 | 6/1957 | McFarlan | 62/434 |
| 3,067,592 | 12/1962 | McFarlan | 62/510 |
| 3,102,397 | 9/1963 | Trucchi | 62/263 |
| 3,392,541 | 7/1968 | Nussbaum | 62/335 |

*Primary Examiner*—Lloyd L. King

[57] ABSTRACT

An air conditioning apparatus which includes an outdoor unit incorporating therein an outdoor heat exchanger working as a condenser during cooling and a fan for cooling the heat exchanger, and a plurality of indoor units each incorporating therein a compressor, an indoor heat exchanger working as an evaporator during cooling and a pressure reducer. The indoor and outdoor units are connected through cooling medium supply and return pipings through which cooling medium at high pressure flows during cooling, while cooling medium at low pressure is caused to flow therethrough during heating for efficient air conditioning and facilitation of installment of the apparatus.

6 Claims, 4 Drawing Figures

AIR CONDITIONING APPARATUS

This is a continuation, of application Ser. No. 692,579, filed June 3, 1976, now abandoned.

The present invention relates to an air conditioner, and more particularly, to an air conditioning apparatus of the so-called separate type having at least one outdoor unit and a plurality of separate indoor units corresponding in number to the number of rooms to be air-conditioned for selectively cooling and heating air within any building structure.

Conventionally, there has been proposed an air conditioning apparatus of the above described type, for example, one as shown in FIG. 1, which includes a plurality of outdoor units *uo*, each having a liquid receiver *l*, a compressor *c*, an outdoor heat exchanger *xo* and a cooling fan or air blower *fo* incorporated therein, and a corresponding plurality of indoor units *ui* separate from the outdoor units and in each of which are incorporated an indoor heat exchanger *xi*, an air blower *fi* and a pressure reducer *d*. A cooling medium supply pipe *sp* which couples each outdoor unit *uo* with the corresponding indoor unit *ui* is connected at its one end to a cooling medium outlet of the outdoor heat exchanger *xo* of the outdoor unit *uo* and, at the other end thereof, to an inlet side of the pressure reducer *d* incorporated in the indoor unit *ui* to form a high pressure side of the cooling medium circuit between the outdoor unit *uo* and the indoor unit *ui*, while a cooling medium return pipe *rp* is connected, at its one end, to the liquid receiver *d* in the outdoor unit *uo*, with the outer end thereof being connected to a cooling medium outlet of the indoor heat exchanger *xi* incorporated in the indoor unit ui, thus forming a low pressure side of the cooling medium circuit.

In the prior art air conditioning apparatus of the separate type having the construction as described above, the liquid used as the cooling medium is raised to a high temperature and high pressure by the compressor *c* and has the heat removed therefrom by the cooling fan *fo* within the outdoor heat exchanger *xo* so that it has a low temperature, and is further led through the supply pipe *sp* toward the indoor unit *ui* in which the pressure thereof is reduced by the pressure reducer *d* in the unit *ui* and the cooling medium is subsequently evaporated within the indoor heat exchanger *xi*. The heat of evaporation taken up by the cooling medium at this time is extracted from the air flow caused by the fan *fi* for circulation of cold air through the room to be air-conditioned thus cooling the air, while the cooling medium passed through the indoor heat exchanger *xi* is led out of the room toward the outdoor unit *xo* where the liquid portion thereof is removed by the liquid receiver *l* installed in the outdoor unit *uo* and the gaseous portion is subsequently returned to the compressor *c*.

The conventional air conditioning apparatus of the above described type, however, has such disadvantages that, since the cooling medium in the liquid state and under high pressure flows through the cooling medium supply pipe *sp* connecting the indoor unit *ui* with the outdoor unit *uo*, while the cooling medium in the gaseous state and under low pressure passes through the return pipe *rp*, the flow path resistances to the cooling medium in the supply and return pipes *sp* and *rp* differ from each other, thus resulting in increased unbalancing of pressure variations in the flow of the cooling medium especially when the cooling medium pipes between the indoor unit *ui* and the outdoor unit *uo* are long. Accordingly, the length of the pipes for the cooling medium can not be increased beyond a certain range because of the reduction in the capacity thereof, which in turn limits the places where the outdoor units can be located, thus resulting in various inconveniences in the installation of the air conditioning apparatus.

Furthermore, in the conventional air conditioning apparatus arranged for conditioning a plurality of rooms with one outdoor unit *uo* as shown in FIG. 2, it has been a common practice to connect the cooling medium circuit for each of the indoor units *ui* in parallel to the supply and return pipes *sp* and *rp* for the outdoor unit *uo*, in which arrangement, the compressor *c* mounted in the outdoor unit *uo* must have a capacity such that all the indoor units *ui* can be operated simultaneously at approximately 100% cooling efficiency from an economical point of view, for example, when three indoor units *ui* (one of which is not shown) are to be installed. For example, if the outdoor unit *uo* operates at its full capacity when two of the three indoor units *ui* are operated, the capacity of each one of the three indoor units *ui* is reduced to ⅔ if the three indoor units *ui* are operated simultaneously, sufficient cooling capacity not being available to run all three indoor units at full capacity. Thus, if the outdoor unit *uo* has a capacity sufficient to allow the three indoor units *ui* to function at 100% efficiency when all three are operating, the outdoor unit *uo* having such a large capacity must be kept operating even when one of the three or two of the three indoor units *ui* are turned off, which arrangement also results in such disadvantages as that not only is the power consumption too large, with a consequent high running cost, but various defects such as excessively rapid cooling arising from too small load, possible damage to the compressor due to back flow of the cooling liquid due to deterioration of the evaporating efficiency of the cooling medium and the like are apt to take place. Furthermore, the compressor *c* installed in the outdoor unit *uo* is inevitably large size in order to provide increased cooling capacity, with consequent large noise during operation, thus giving rise to the possibility of public nuisance.

Similarly, in the conventional arrangement wherein a plurality of separate type air conditioners each having an indoor unit and an outdoor unit which are combined in a pair and corresponding in number to the number of rooms are individually installed in the respective rooms, the number of outdoor units must naturally be the same as the number of indoor units, thus increasing not only the area required for installing the outdoor units, but also the cost of the air conditioning apparatus itself. In addition, in the air conditioning apparatus as described above, since the capacities of the heat exchangers *xo* incorporated in the outdoor units *uo* are the same, the capacities of the heat exchanges in the indoor units *ui* must also be the same, which fact results in insufficiency or excess in the capacities of the indoor units, depending on the sizes of the rooms to be air-conditioned, thus hampering achievement of optimum air conditioning.

Accordingly, an essential object of the present invention is to provide an air conditioning apparatus of the so-called separate type in which unbalancing of pressure variations due to flow path resistance to cooling medium in the supply and return pipes between an outdoor unit and indoor units is sufficiently reduced to achieve smooth flow of the cooling medium therebetween.

Another important object of the present invention is to provide an air conditioning apparatus of the above described type in which the indoor units are adapted to be operated at full capacity irrespective of the number thereof being operated even when the number of such indoor units are the same as the number of rooms to be air-conditioned.

A further object of the present invention is to provide an air conditioning apparatus of the above described type in which the area to be occupied by the outdoor unit is reduced to an area as small as possible to facilitate installation of the same, with the noise from such an outdoor unit being limited to a minimum level so as to eliminate any public nuisance resulting therefrom.

A still further object of the present invention is to provide an air conditioning apparatus of the above described type which is capable of effecting air conditioning corresponding to the outputs of the indoor units even when a plurality of indoor units having different outputs are employed.

Another object of the present invention is to provide an air conditioning apparatus of the above described type which is simple in construction and stable during functioning, and can be manufactured at a low cost.

According to a preferred embodiment of the present invention, the air conditioning apparatus includes an outdoor unit in which an outdoor heat exchanger functioning as a condenser during cooling and a cooling fan or blower for cooling the heat exchanger are accommodated, and a plurality of indoor units each incorporating therein a compressor, an indoor heat exchanger working as an evaporator, and a pressure reducer. In the cooling medium supply and return pipes connecting the outdoor unit and the indoor units, cooling medium at high pressure is caused to flow during cooling, with cooling medium at low pressure being caused to flow therethrough during heating for reducing unbalance in pressure variations due to flow path resistances to the cooling medium in the supply and return pipes to achieve smooth flow of the cooling medium therethrough and consequently to make it possible to extend the length of the cooling medium pipes whereby installation of the indoor and outdoor units is facilitated to a large extent. Furthermore, in cases where a plurality of indoor units are to be installed corresponding to the number of rooms to be air conditioned, the cooling medium circuit for each of the indoor units is separately connected to the outdoor unit in an independent circuit for enabling the indoor units to be always operated at full capacity irrespective of the number of indoor units to be operated and their outputs, while noise to be developed by the outdoor unit is reduced to a minimum level to eliminate any public nuisance resulting from such noise.

These and other objects and features of the present invention will become apparent from the following description taken in conjunction with the attached drawings in which.

Before the description of the present invention proceeds, it is to be noted that like parts are designated by like reference numerals throughout the views of the attached drawings.

Figure 1:
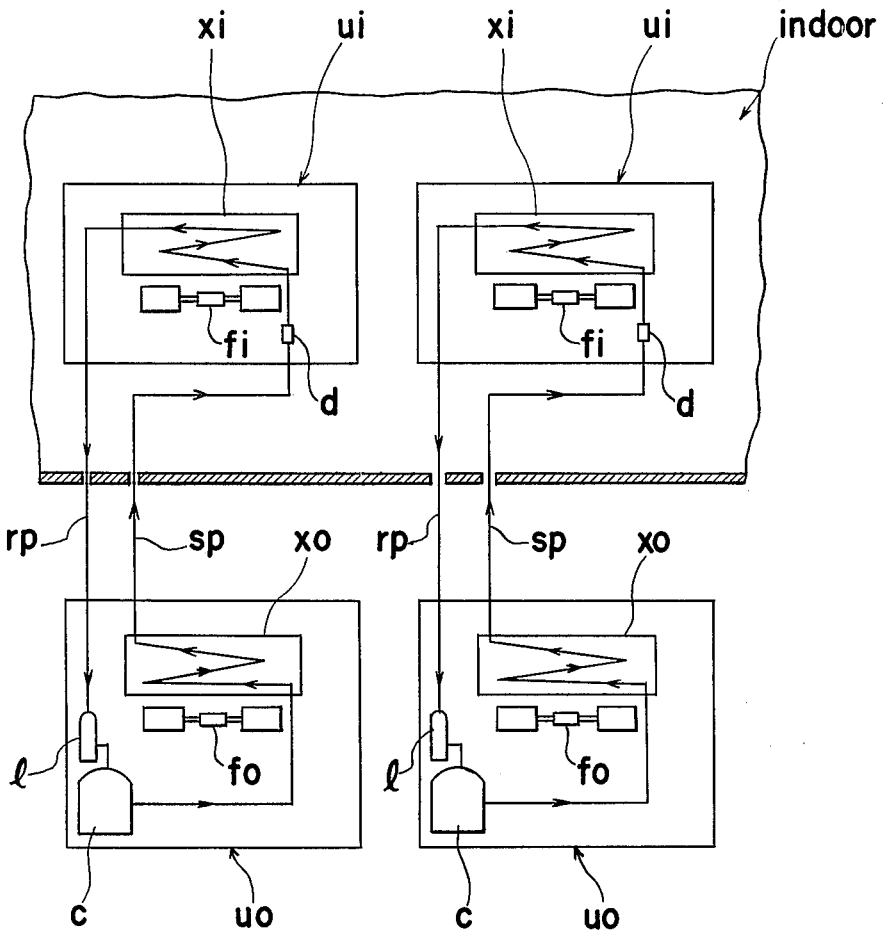
FIG. 1 Prior Art
FIGS. 1 and 2 are schematic diagrams of the arrangement of prior art air conditioning apparatuses.
Figure 2:
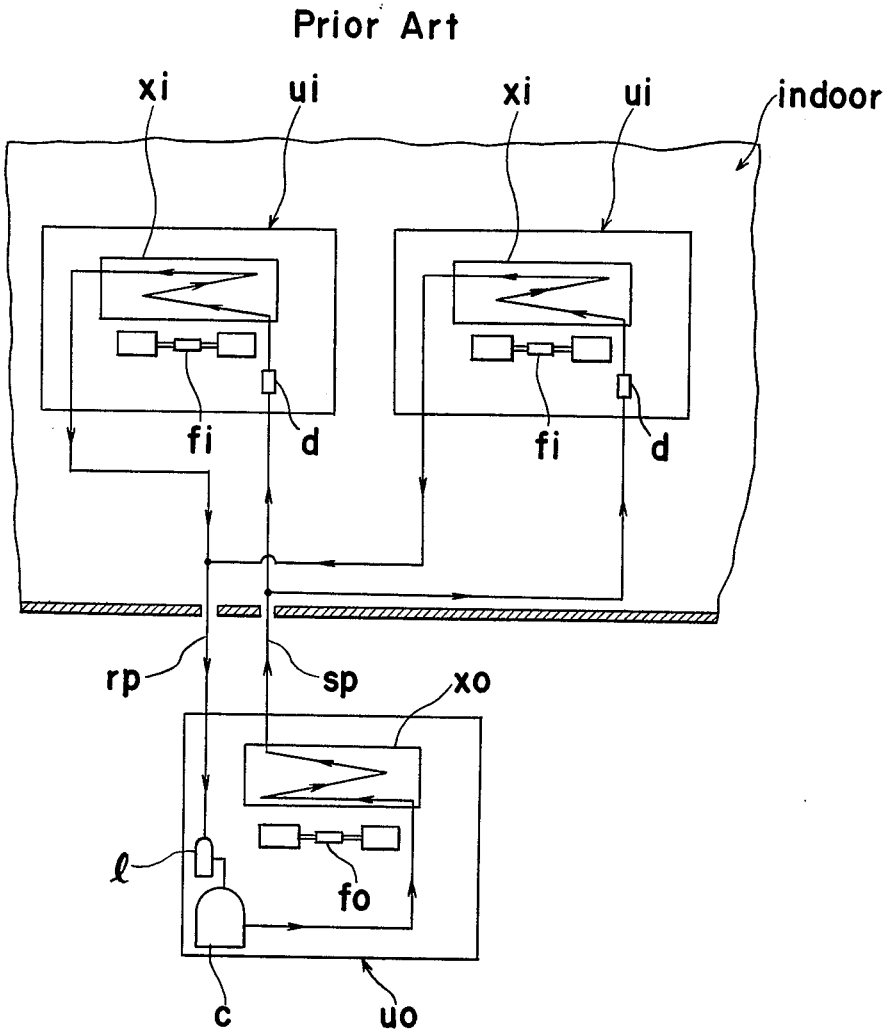
Figure 3:
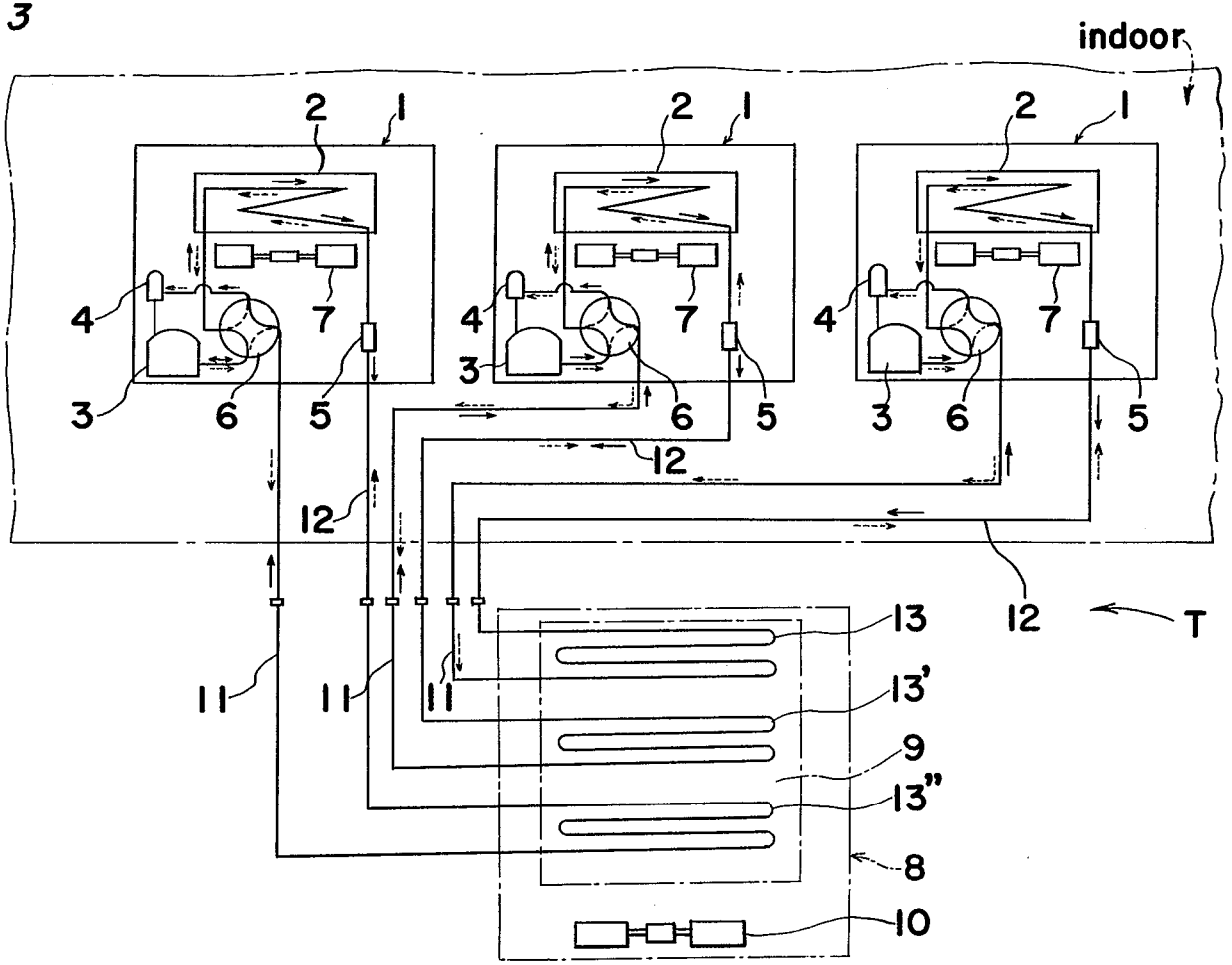
FIG. 3 is a schematic diagram showing the arrangement of an air conditioning apparatus according to one embodiment of the present invention.

Referring now to FIG. 3, there is shown an air conditioning apparatus T according to one embodiment of the present invention, which generally comprises a plurality of indoor units 1 each incorporating therein an indoor heat exchanger 2 which functions as an evaporator during cooling, a compressor 3, a liquid receiver 4, a pressure reducer 5, a four part two-way valve 6 for switching over between cooling to heating and a fan 7, and an outdoor unit 8 in which an outdoor heat exchanger 9 and a fan 10 for cooling the heat exchanger 9 are incorporated. In the outdoor heat exchanger 9, a plurality of cooling medium pipes 13, 13' and 13" communicated with the outdoor units 1 and having common fins common are provided for forming independent circuits for the cooling medium. Cooling medium pipes 11 for connecting the indoor units 1 with the outdoor unit 8 are each connected at one end thereof to the cooling medium inlet of one of the cooling medium pipes in the outdoor heat exchanger 9 of the outdoor unit 8, while the other end thereof is connected to the four sided valve 6 in the corresponding indoor unit 1. Similarly, the cooling medium pipes 12 also connecting the indoor units 1 to the outdoor unit 8 are each connected at one end to a cooling medium outlet of one of the cooling medium pipes in the outdoor heat exchanger 9 incorporated in the outdoor unit 8, with the other end thereof being connected to the inlet side of the pressure reducer 5 in the corresponding indoor unit 1.

With the above arrangement, when the air conditioning apparatus T is to be operated for cooling, the flow of the cooling medium is switched over by the four part two-way valve 6 so that the outdoor heat exchanger 9 in the outdoor unit 8 performs a condensation action. Upon subsequent operation of the compressor 3 by a suitable power source (not shown), the cooling liquid at a high temperature and high pressure from said compressor 3 in each of the indoor units 1 is caused to flow through the respective cooling medium pipes 13, 13' and 13" in the outdoor heat exchanger 9 of the outdoor unit 8, during which time the cooling medium has heat removed therefrom by the air flow caused by the fan 10. The cooling liquid thus cooled to a low temperature and high pressure is subsequently led into the indoor units 1 through the pipes 2 where the pressure thereof is reduced by the pressure reducer 5 and it is also evaporated by the indoor heat exchanger 2 in each of the indoor units 1, in which process, the heat of evaporation extracts heat from and cools the air flow caused by the fan 7 of the indoor unit 1 for air conditioning of the rooms wherein the indoor units 1 are installed. The cooling medium which has passed through the indoor heat exchanger 2 has any liquefied part removed by the liquid receiver 4 of the indoor unit 1 and the cooling medium in the form of gas is returned to the compressor 3 to repeat the cooling cycle. It should be noted here that in the case of cooling, cooling medium under high pressure is adapted to flow through both the cooling medium pipes 11 and 12. On the other hand, when the apparatus T is to be operated for heating, the valve 6 is switched to change the direction of flow of the cooling medium so that the outdoor heat exchanger 9 in the outdoor unit 8 functions as an evaporator, with the fans 7 and 10 and the compressor 3 being driven, in which case, the cooling liquid at a high temperature and high pressure from the compressor 3 in each of the indoor units 1 is caused to flow through the indoor heat exchanger 2 and gives up heat to the air caused to flow over the heat exchanger 2 by the fan 7 for heating the air in the room. The cooling liquid cooled to a low temperature and still at a high pressure has its pressure reduced by the pressure reducer 5, thus the cooling medium to a low temperature and low pressure medium which then flows through the cooling medium pipes 13, 13′ and 13″ of the outdoor heat exchanger 9 and is evaporated therein and subsequently being returned to the compressor 3. It is to be noted that, in the above case, cooling medium at low pressure flows through both of the cooling medium pipes 11 and 12.

Figure 4:
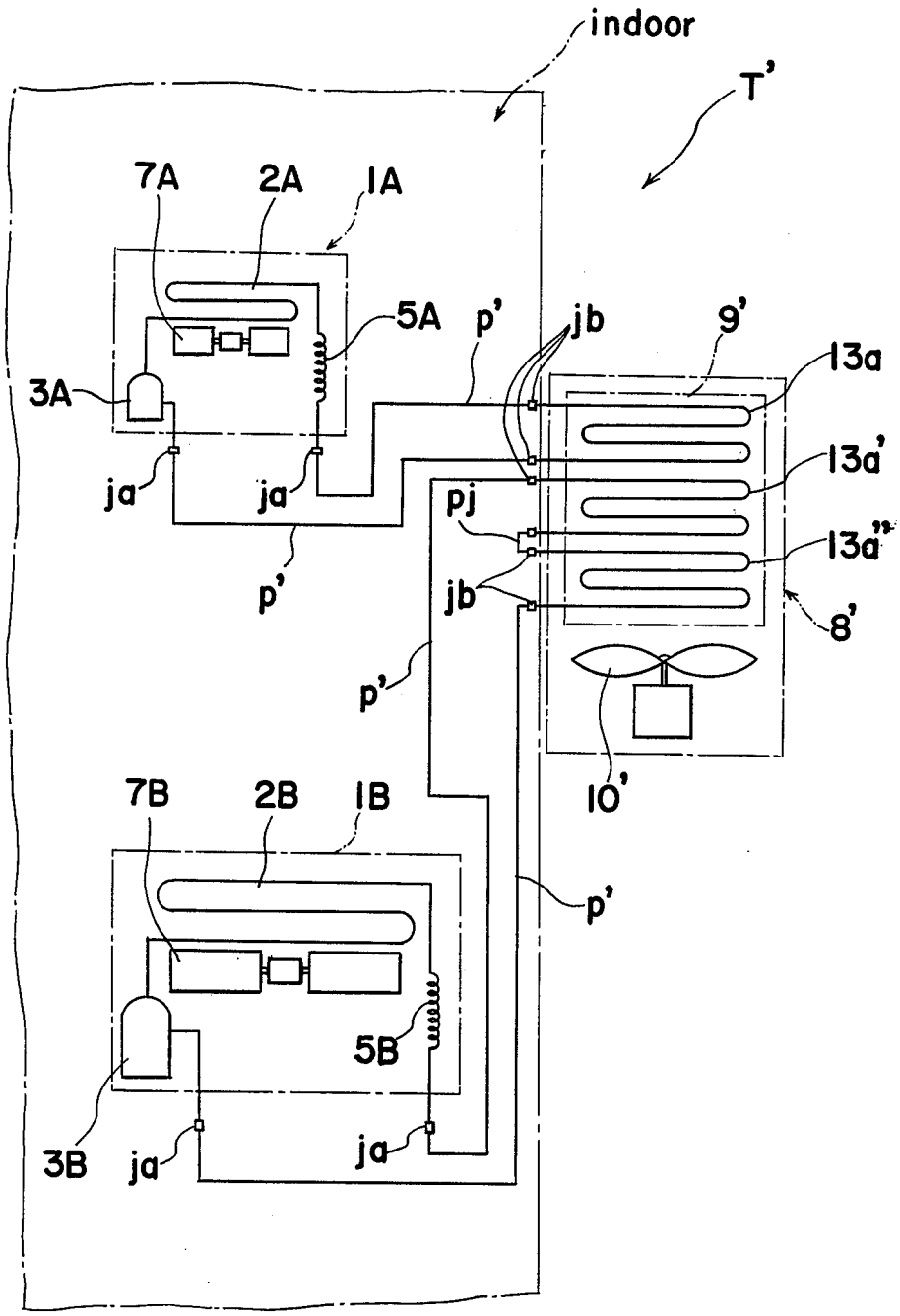
FIG. 4 is a view similar to FIG. 3, but particularly showing a modification thereof.

Referring now to FIG. 4, there is shown a modification of the air conditioning apparatus T of FIG. 3. The modified air conditioning apparatus T′ of FIG. 4 is intended for use when the outputs of the indoor units are different from each other, and the three indoor units 1 each having the same output described as employed in the apparatus T of FIG. 3 are replaced, by way of example, with two indoor units 1A and 1B having different outputs.

In FIG. 4, the air conditioning apparatus T′ generally includes a small sized indoor unit 1A having a compressor 3A, an indoor heat exchanger 2A, a pressure reducer 5A and a fan 7A incorporated therein, a large sized indoor unit 1B in which a compressor 3B, an indoor heat exchanger 2B, a pressure reducer 5B and a fan 7B are incorporated, and an outdoor unit 8′ incorporating therein an outdoor heat exchanger 9′ which includes a plurality of sets of independent cooling medium pipes 13*a*, 13*a*′ and 13*a*″, and a fan 10′. The outdoor unit 8′ is coupled to the indoor units 1A and 1B by cooling medium pipes *p*′ connected between corresponding connectors *ja* of the indoor units 1A and 1B, and connectors *jb* of the outdoor unit 8′, with a connecting pipe *pj* being provided between one of the sets of the connectors *jb* of the outdoor unit 8′ for connecting the cooling medium pipes 13*a*′ and 13*a*″ of the outdoor heat exchanger 9′ in series, depending on the necessity. It will be assumed for purposes of explanation that the compressor 3A of the small sized indoor unit 1A has an output of one horse power, while the compressor 3B of the large sized indoor unit 1B has an output of two horse power, with the capacity of each of the plurality of cooling medium pipes 13*a*, 13*a*′ and 13*a*″ of the outdoor heat exchanger 9′ being equivalent to one horse power of the compressor 3A of the small sized indoor unit 1A. The indoor unit 1A is connected to the cooling medium pipe 13*a* of the outdoor heat exchanger 9′, while the large sized indoor unit 1B is connected in series to the cooling medium pipes 13*a*′ and 13*a*″ of the outdoor heat exchanger 9′ by the connecting pipe *pj* for connecting the cooling medium pipes 13*a*′ and 13*a*″ to the cooling medium circuit. In other words, the small sized indoor unit 1A is connected to one pipe 13*a* of the cooling medium pipes equivalent to one horse power of the output of the compressor 3A of the small sized indoor unit 1A, while the large sized indoor unit 1B is connected to two pipes 13*a*′ and 13*a*″ equivalent to two horse power of the output of the compressor 3B of the large sized indoor unit 1B.

As is clear from the foregoing description, according to the present invention, the air conditioning apparatus of FIG. 3 includes a plurality of indoor units in each of which is incorporated the compressor, the indoor heat exchanger working as an evaporator during cooling, the liquid receiver, the blower or fan and a four-part two-way valve for switching over between cooling and heating, and an outdoor unit having the outdoor heat exchanger having the separate cooling medium pipes which are connected to the corresponding units of said plurality of the indoor units and which are each arranged to form part of an independent cooling medium circuit, and the fan or blower for cooling, by which arrangement, cooling medium at high pressure flows through both of the supply and return pipes during cooling, while cooling medium at low pressure flows through the same pipes during heating, so that unbalancing of pressure variations due to flow path resistance in the supply and return cooling medium pipes is reduced to a minimum, thus extension of the cooling medium pipes being made possible for facilitating the proper choice of the places for installing the indoor and outdoor units. Furthermore, since the outdoor heat exchanger having separate cooling coils constituting the cooling medium circuit for each of the indoor units is accommodated in a single outdoor unit, an increase of the area occupied by the outdoor unit is advantageously prevented, with consequent facilitation for installing the outdoor unit. It is another advantage of the air conditioning apparatus of the invention that since the compressor is enclosed in the indoor unit, the problems of public nuisance due to compressor noise in the outside unit are eliminated.

In addition, according to the embodiment of the air conditioning apparatus of FIG. 4, the plurality of cooling pipes constituting the outdoor heat exchanger of the outdoor unit are arranged to be connected either independently or in groups to the indoor units so as to correspond to the outputs of the indoor units, even when a plurality of the indoor units having compressors of different outputs are to be installed, so that a plurality of indoor units having different outputs can be readily installed, and moreover, since each of the indoor units constitutes an independent cooling medium circuit, such an indoor unit is free from any variations in its capacity.

Needless to say that the number of indoor units described as employed in the embodiments of FIGS. 3 and 4 are not limited to three and two units, but may be increased or decreased, depending on necessity.

It should also be noted that the noises from the compressors of the indoor units can readily be suppressed to a minimum level by various known arrangements for comfortable air conditioning.

Although the present invention has been fully described by way of example with reference to the attached drawings, it is to be noted that various changes and modifications will be apparent to those skilled in the art. Therefore, unless otherwise such changes and modifications depart from the scope of the present invention they should be construed as included therein.

What is claimed is:

1. An air conditioning apparatus which comprises: at least one outdoor unit having therein an outdoor heat exchanger, said outdoor heat exchanger having a plurality of coils each constituted by at least one heat exchange medium pipe and acting as a condenser when the apparatus is used for cooling and as an evaporator when the apparatus is used for heating; a plurality of indoor units for air conditioning individual indoor spaces and corresponding in number to the number of said coils in said outside heat exchanger, each of said indoor units having a compressor, an indoor heat exchanger acting as an evaporator when the apparatus is used for cooling and as a condenser when the apparatus is used for heating; pipe means connecting each indoor unit with a corresponding one of said coils in said outdoor heat exchanger of said outdoor unit; and a four way valve in each indoor unit connected between said compressor and said indoor heat exchanger and said pipe means for switching flow of heat exchange medium from a flow from said compressor to said indoor heat exchanger and from said outdoor heat exchanger to said compressor to a flow from said compressor to said outdoor heat exchanger and from said indoor heat exchanger to said compressor, whereby the pressure of the heat exchange medium flowing in said pipe means is substantially uniform at a high pressure when said apparatus is used for cooling and substantially uniform at a low pressure when said apparatus is used for heating.

2. An air conditioning apparatus as claimed in claim 1, wherein said outdoor unit is further provided with blower means for cooling said outdoor heat exchanger.

3. An air conditioning apparatus as claimed in claim 1, wherein said indoor heat exchanger is further provided with blower means.

4. An air conditioning apparatus as claimed in claim 1, wherein said cooling medium pipes in said outdoor heat exchanger are incorporated into one unit.

5. An air conditioning apparatus as claimed in claim 1, wherein each of the plurality of cooling medium pipes in said outdoor heat exchanger of said outdoor side unit is independently connected to a corresponding one of said indoor units and is capable of handling the output of said corresponding indoor unit.

6. An air conditioning apparatus as claimed in claim 1, wherein at least two of the plurality of cooling medium pipes in said outdoor heat exchanger of said outdoor side unit are connected in series to form a coil and connected to a single indoor unit and there is at least one further single cooling medium pipe in said outdoor heat exchanger connected to a further single indoor unit.

* * * * *